US011292645B1

(12) United States Patent
Allen

(10) Patent No.: US 11,292,645 B1
(45) Date of Patent: Apr. 5, 2022

(54) SPOUT SEAL ASSEMBLY

(71) Applicant: Von Payne Spirits, LLC, Clearwater, FL (US)

(72) Inventor: Steven Scott Allen, Clearwater, FL (US)

(73) Assignee: Von Payne Spirits, LLC, Clearwater, FL (US)

( * ) Notice: Subject to any disclaimer, the term of this patent is extended or adjusted under 35 U.S.C. 154(b) by 0 days.

(21) Appl. No.: 17/126,520

(22) Filed: Dec. 18, 2020

(51) Int. Cl.
*B65D 47/40* (2006.01)
*B65D 47/12* (2006.01)

(52) U.S. Cl.
CPC ..... *B65D 47/40* (2013.01); *B65D 47/122* (2013.01); *B65D 2547/066* (2013.01)

(58) Field of Classification Search
CPC . B65D 47/40; B65D 47/122; B65D 2547/066
USPC ..... 222/481
See application file for complete search history.

(56) References Cited

U.S. PATENT DOCUMENTS 3,422,998 A * 1/1969 Murray ..... B65D 47/06 222/567
3,630,419 A * 12/1971 Pierce ..... B65D 47/06 222/478
3,966,099 A * 6/1976 Sanford, Jr. ..... B67D 3/00 222/478
5,397,027 A * 3/1995 Koch ..... G01F 11/262 222/1
5,799,836 A * 9/1998 Lee ..... B65D 47/06 222/189.07
6,230,944 B1 5/2001 Castellano et al.
6,742,678 B1 6/2004 Krystopik, Jr.
7,185,775 B1 * 3/2007 Decal ..... A61J 11/04 215/11.1
8,245,891 B2 8/2012 Eriksen
8,944,297 B2 * 2/2015 Agassi ..... B65D 47/263 222/481.5
9,033,187 B2 * 5/2015 Luebke ..... B01F 3/0446 222/190
9,370,791 B1 * 6/2016 Nguyen ..... B65B 31/047
10,329,054 B1 * 6/2019 Haldiman ..... B65D 47/243

* cited by examiner

*Primary Examiner* — Jeremy Carroll
(74) *Attorney, Agent, or Firm* — Smith & Hopen, P.A.; Michele L. Lawson

(57) ABSTRACT

A removable spout seal and pour spout assembly is presented. The removeable spout seal generally comprises a cylindrical attachment member attached to a flange with a channel extending distally perpendicular therefrom. The removeable spout seal is coupled to a pour spout to form the pour spout assembly. In use, the removeable spout seal attaches to the connection member of a pour spout to provide a seal that prevents leaking of liquids from a vessel. The vent tube of the pour spout is inserted into the channel of the spout seal apparatus and the cylindrical attachment member of the spout seal is inserted into the connection member of the pour spout to form a leakproof seal. Use of the spout seal allows shipping a vessel with the pour spout in place thus preventing leaking during shipping; prevents contamination of contents; preserves freshness of contents; and prevents accidental spills and leaking.

19 Claims, 10 Drawing Sheets

SPOUT SEAL ASSEMBLY

FIELD OF THE INVENTION

This invention relates to a novel spout seal. More particularly, it relates to a spout seal and spout seal assembly to prevent liquid from leaking from a bottle.

BACKGROUND OF THE INVENTION

Pour spouts are well known in the art to aid a user in pouring liquid from a vessel. Pour spouts allow for a continuous flow of liquid from the vessel into another container. Most prior art pour spouts have a lower portion that is insertable into the neck of a bottle with a pour spout conduit extending outwardly from, and through, a circular base attached to this lower insertable portion. Most prior art pour spouts also include a vent tube which extends from an opening in the surface of circular base through interior of connection member. Vent tube allows for air to enter vessel when liquid is being poured which permits the pressure to equalize within the bottle and encourage an even flow of the liquid from the vessel.

One problem faced with the use of pour spouts as an integrated part of the product and packaging is that there has previously not been a means to seal the spout when in place on the vessel. If one desired to include a pour spout with the bottled product, separate additional packaging for the pour spout itself was needed. One could not ship a vessel with the pour spout mounted in place on the vessel without having the contents leak out of the vessel. Further, when using a decorative housing with a pour spout to form an ornamental pour spout, having the ornamental pour spout mounted in place on the vessel for point-of-sale viewing is desirable to show the consumer the complete package and enhance the sale of the product.

Another problem facing the use of pour spouts is that sealing the bottle after initial use required removing the pour spout and recapping the vessel with the original cap, which is cumbersome and time consuming. On the other hand, leaving the pour spout on the vessel without a seal, can introduce contaminants into the contents of the vessel. Further, in the case of liquor bottles, the contents may begin to evaporate in an unsealed vessel. An unsealed pour spout also runs the risk of the contents leaking during accidental spills.

U.S. Pat. No. 6,230,944 attempted to solve the problems described above by describing a pour spout which uses a sealing cap over the dispensing end of the nozzle of the pour spout. Having a sealing cap on the nozzle increases the chances that the cap can become misplaced once removed or that the cap will be accidently loosened or removed thus defeating its purpose.

U.S. Pat. No. 6,742,678 describes a pour spout assembly that includes a cap that is securable to the bottle to prevent loss of the cap once removed. As noted previously, positioning a cap externally on the nozzle does not prevent the cap from being dislodged and accidently loosened.

U.S. Pat. No. 8,245,891 discloses a one piece pour spout where, when inserted into the neck of a bottle, the pouring end is flush with the lip of the neck of the bottle thus allowing the original bottle cap to be placed over the pour spout. This design does not allow for curved configurations of the pour spout. Further, it does not overcome the cap becoming misplaced when removed or loosened accidently.

As illustrated above, the prior art has several disadvantages when it comes to providing a leak-proof assembly for a bottle used for pouring liquids. These disadvantages include the inability to ship a vessel with the pour spout in the vessel; potential loss of caps that are used at the nozzle of the pour spout; failure to get an airtight seal with use of external caps; evaporation of contents from inside the vessel; and introduction of contaminants into the vessel. Accordingly, what is needed is a removeable seal assembly that is capable of attaching to a pour spout for a vessel such as a standard liquor bottle, to provide an airtight seal.

SUMMARY OF INVENTION

The present invention relates to a removeable spout seal apparatus that can be coupled to a pour spout to provide an airtight seal. This allows the pour spout to remain on a vessel such as a liquor bottle, without concern for evaporation of the contents of the bottle, contamination of the contents of the bottle or leaking of the liquid from the bottle through the pour spout or vent tube. The removeable spout seal couples to the bottom of the pour spout to cover both the vent tube and the pour spout conduit. Being that the spout seal couples to the bottom of the pour spout, which when in use is inserted into the neck of the bottle, the spout seal is also contained within the bottle and thus avoids the disadvantages of an external seal on the nozzle of the pour spout.

In an embodiment, a removable spout seal apparatus is presented comprising: a cylindrical attachment member having opposing ends and an inner and an outer wall; a flange having top and bottom surfaces wherein the top surface of the flange is fixedly attached to an end of the cylindrical attachment member wherein the bottom surface of the flange contains a bore opening; and a channel formed from the bore opening and extending perpendicularly from a bottom surface of the flange. The channel is sized to accommodate a vent tube of a pour spout. The spout seal apparatus is sized for insertion into a neck of a vessel.

In some embodiments, gripping means may be fixedly attached to the bottom surface of the flange and/or to an outer wall of the channel.

The cylindrical attachment member is smaller in diameter than the diameter of the flange. The cylindrical attachment member is sized for insertion into a connection member of a pour spout.

In another embodiment, a pour spout assembly is presented comprising: a pour spout coupled to a removeable spout seal apparatus.

The spout seal apparatus is comprised of: a cylindrical attachment member having opposing ends and an inner and an outer wall; a flange having top and bottom surfaces wherein the top surface of the flange is fixedly attached to an end of the cylindrical attachment member wherein the bottom surface of the flange contains a bore opening; and a channel formed from the bore opening and extending perpendicularly from a bottom surface of the flange. The cylindrical attachment member is smaller in diameter than the diameter of the flange. The cylindrical attachment member is sized for insertion into a connection member of a pour spout. The channel is sized to accommodate a vent tube of a pour spout. The spout seal apparatus is sized for insertion into a neck of a vessel. In some embodiments, gripping means may be fixedly attached to the bottom surface of the flange and/or to an outer wall of the channel.

The pour spout of the pour spout assembly may comprise: a pour spout conduit having opposing proximal and distal ends wherein the proximal end terminates in a nozzle; a vent tube having opposing proximal and distal ends and positioned a distance from the pour spout conduit; and a connection member sized for insertion into a neck of a vessel wherein the pour spout conduit and the vent tube extend through a hollow cylinder of the connection member.

In some embodiments, the pour spout may further comprise a pour spout housing enclosing proximal end of pour spout conduit. The pour spout housing may contain a circular opening in alignment with and corresponding in size to the nozzle of pour spout conduit. The pour spout housing may be coupled to a circular base.

In a further embodiment, a method of preventing liquid from leaking out of a vessel having a pour spout is presented comprising: coupling a spout seal apparatus to the pour spout to form a pour spout assembly and inserting the pour spout assembly into a neck of the vessel. The spout seal apparatus forms a seal with the pour spout to prevent the leaking of the liquid from the vessel. The spout seal apparatus may be comprised of: a cylindrical attachment member having opposing ends and an inner and an outer wall; a flange having top and bottom surfaces wherein the top surface of the flange is fixedly attached to an end of the cylindrical attachment member wherein the bottom surface of the flange contains a bore opening; and a channel formed from the bore opening and extending perpendicularly from a bottom surface of the flange.

When coupled, a vent tube of the pour spout is positioned within the channel of the spout seal apparatus and the cylindrical attachment member is inserted into a connection member of the pour spout to provide the seal.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
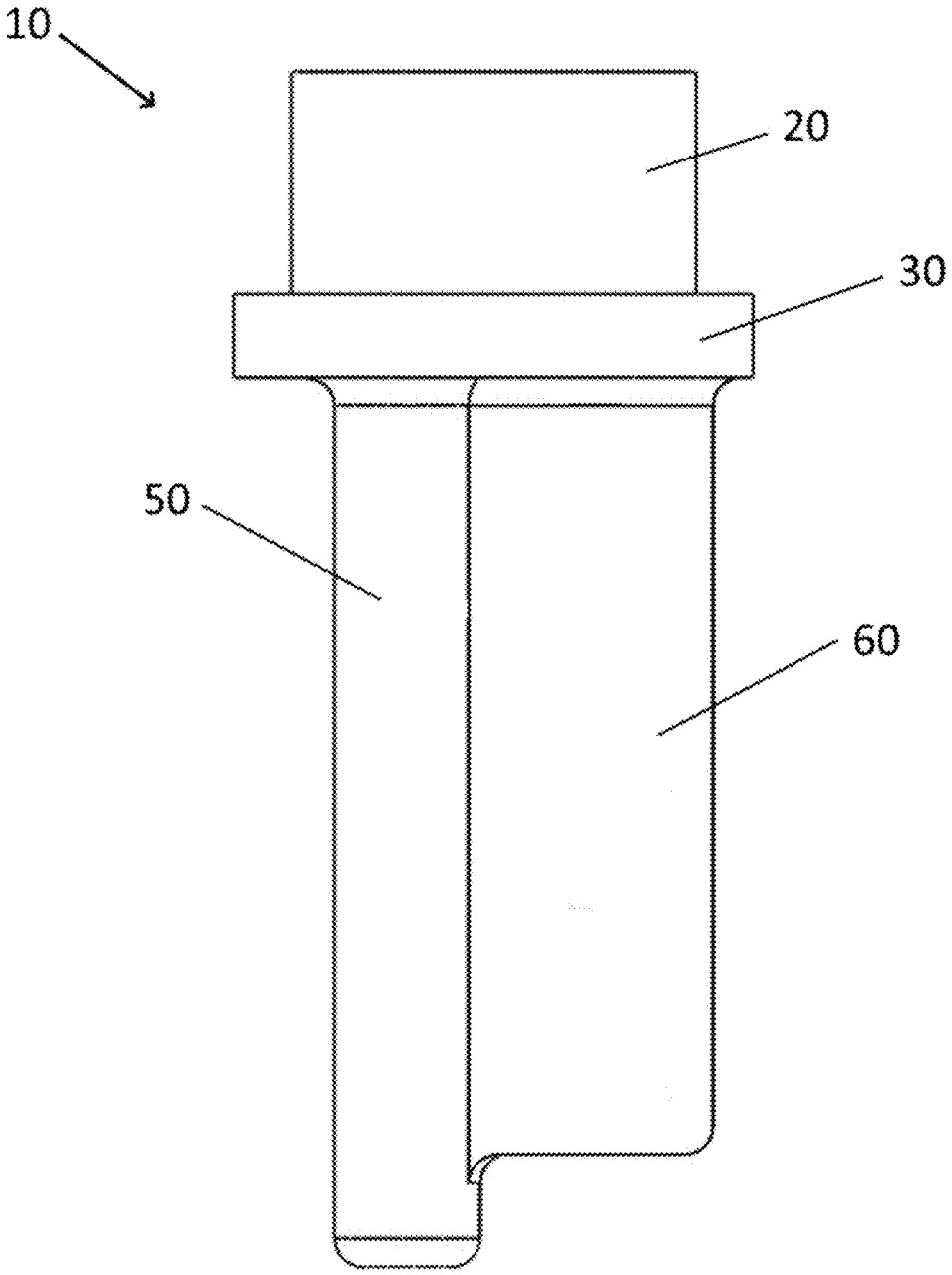
FIG. 1 is a side view of the spout seal embodiment having gripping means.
Figure 2:
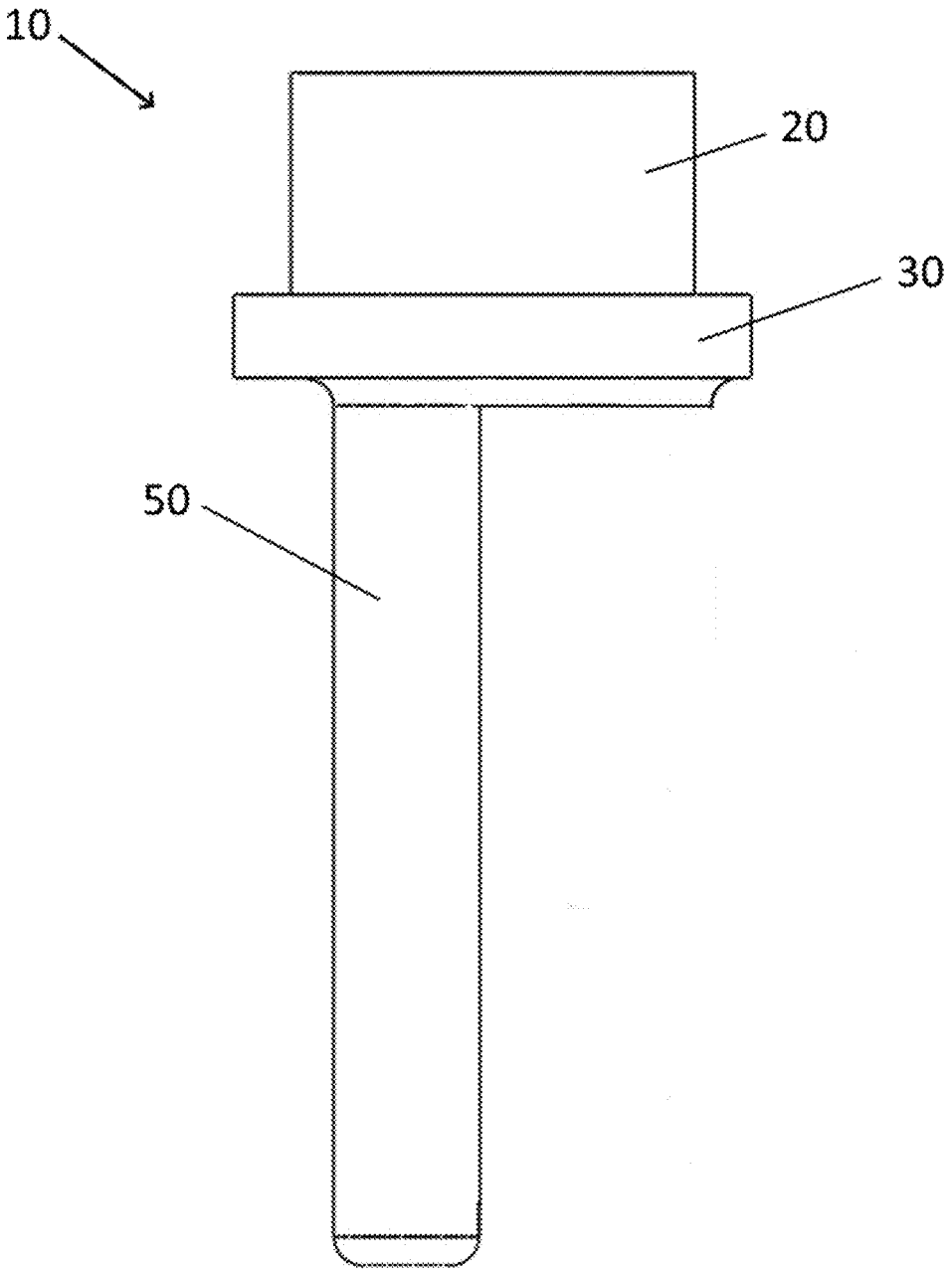
FIG. 2 is a side view of the spout seal embodiment without gripping means.
Figure 3:
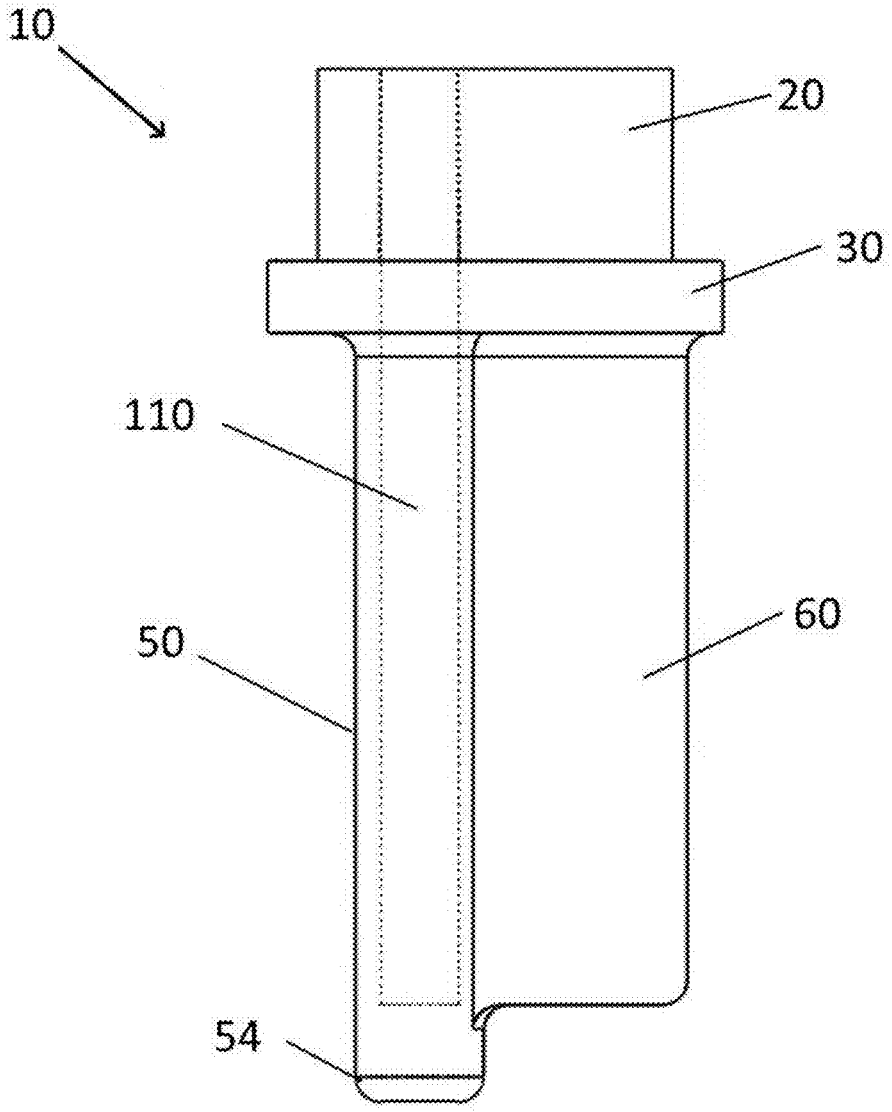
FIG. 3 is a cross sectional view of the spout seal illustrating the interior chamber.
Figure 4:
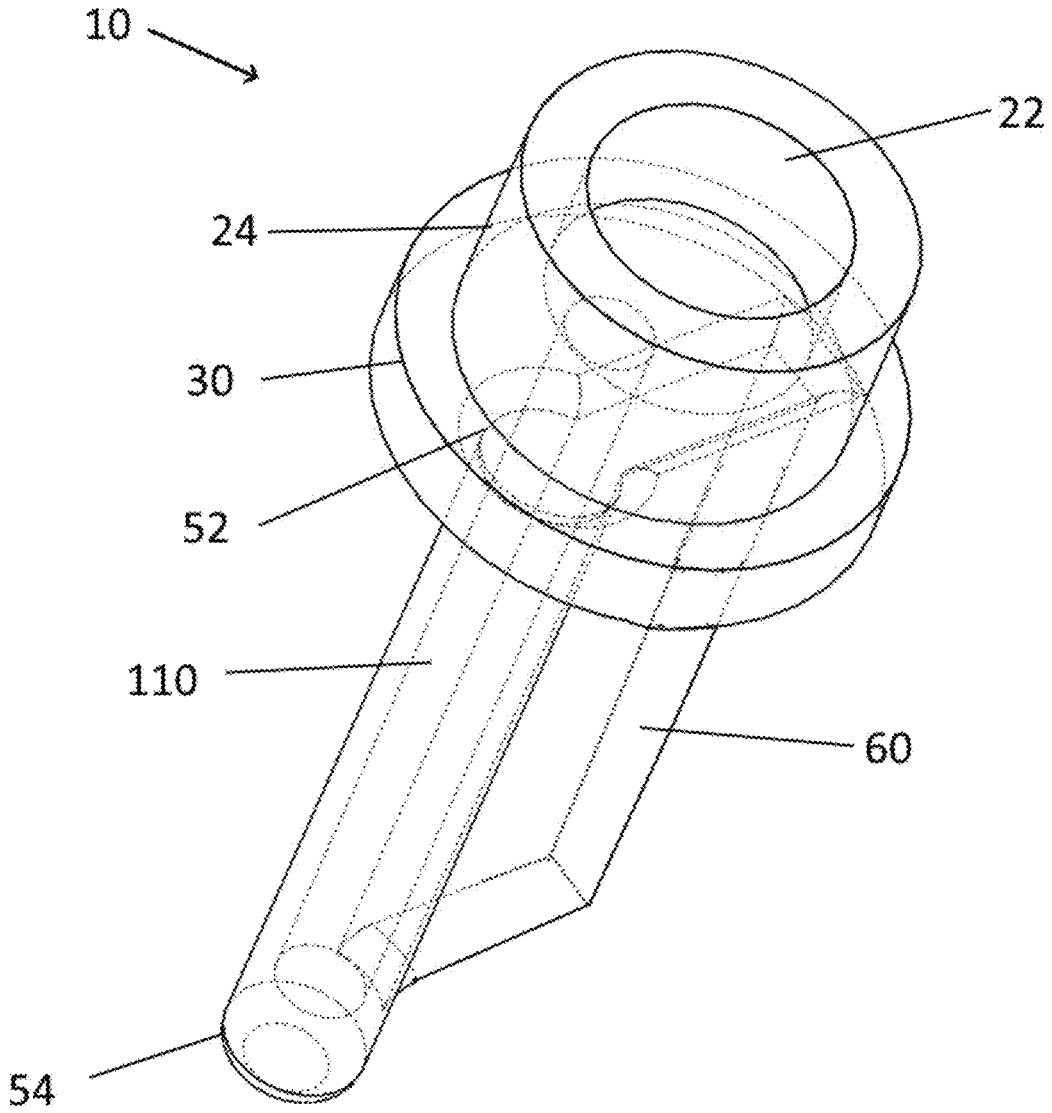
FIG. 4 is a top perspective cross sectional view of the spout seal.
Figure 5:
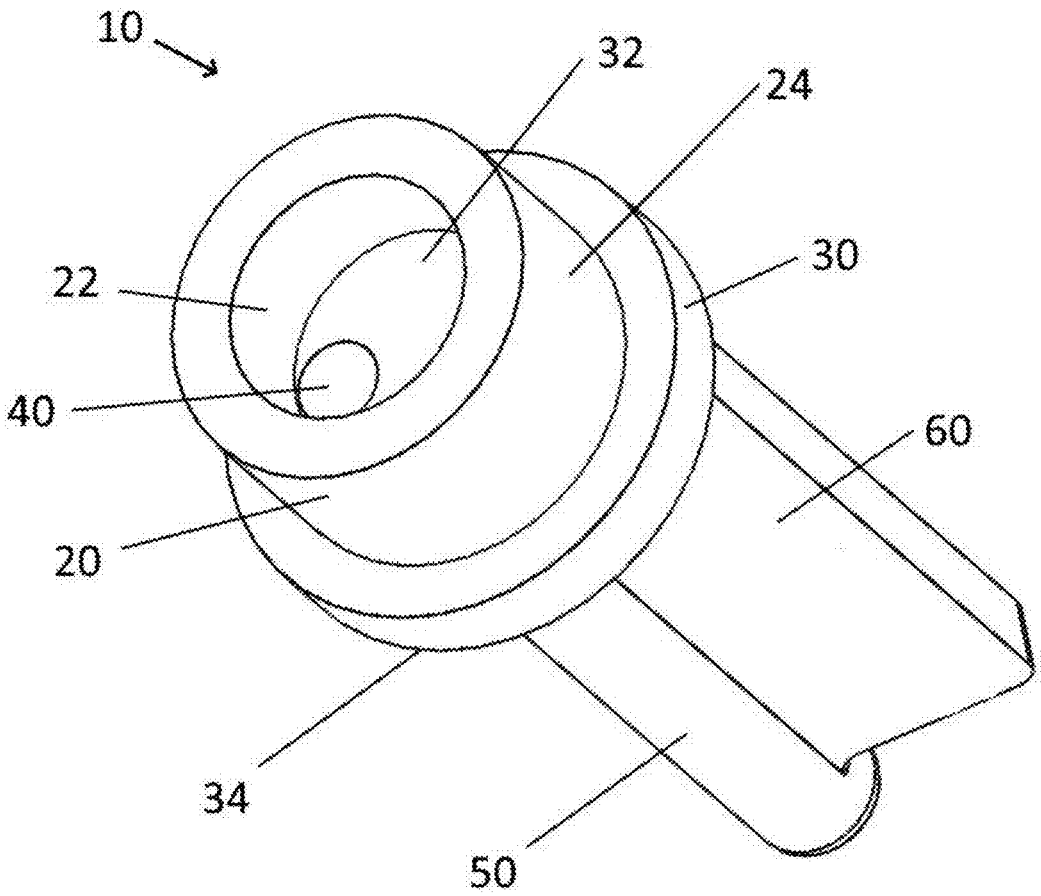
FIG. 5 is a top perspective view of the spout seal.
Figure 6:
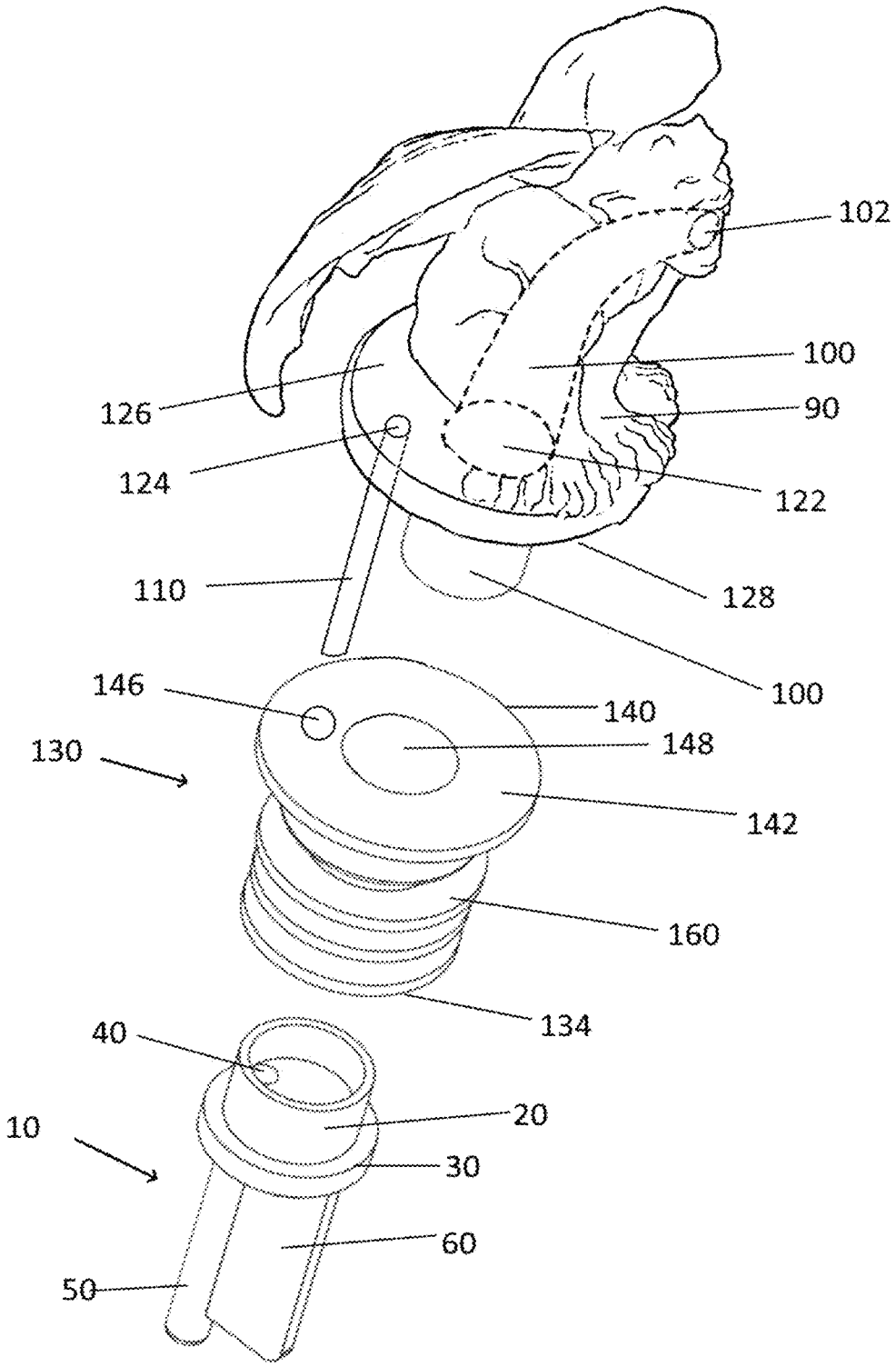
FIG. 6 is a top perspective view of the pour spout assembly showing the novelty pour spout housing, elastomeric connection member and spout seal.
Figure 7:
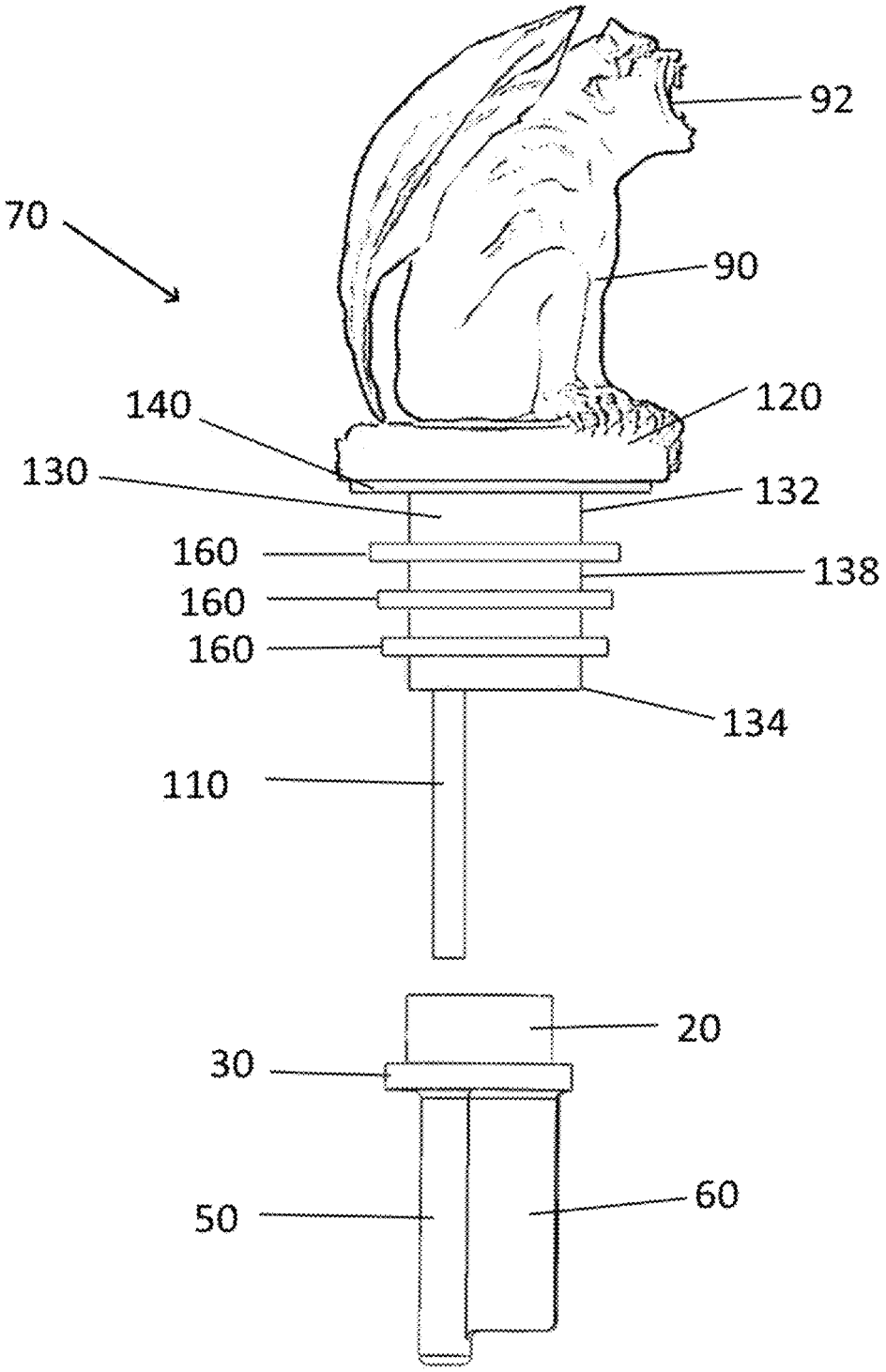
FIG. 7 is a side view of the spout seal assembly showing the pour spout housing assembled on the connection member to form the pour spout and insertion into the spout seal.
Figure 8:
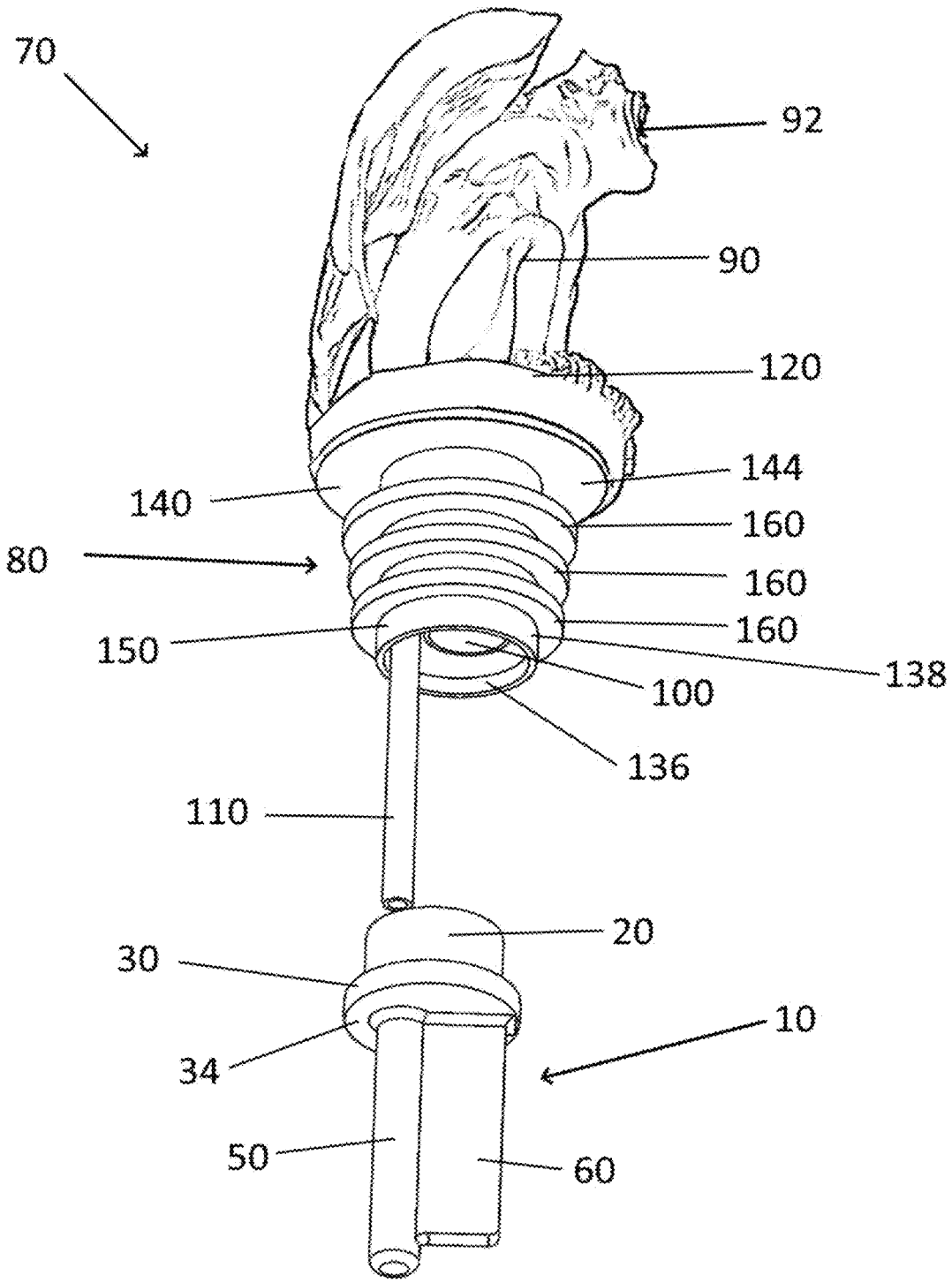
FIG. 8 is a bottom perspective view of the pour spout assembly.
Figure 9:
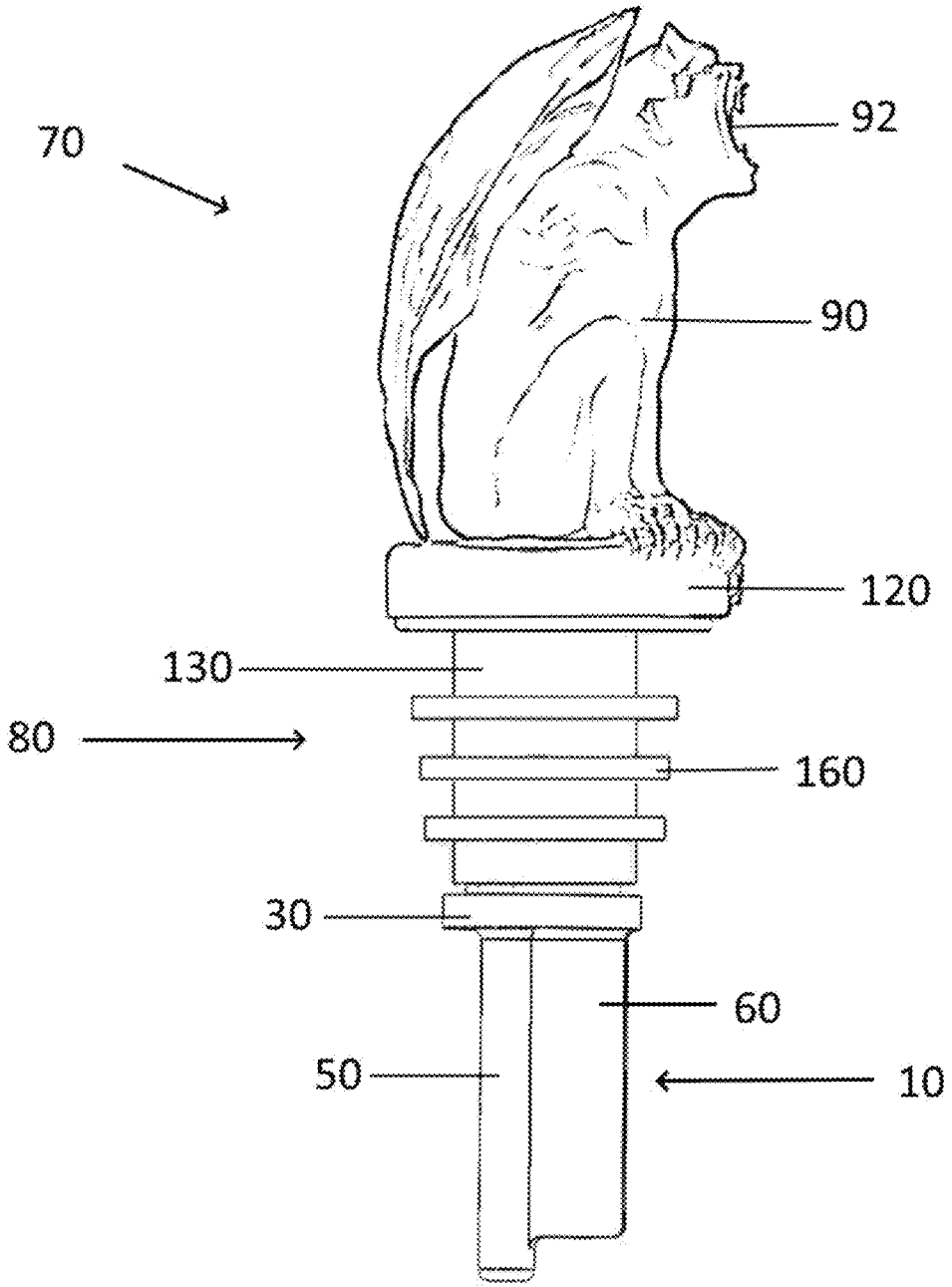
FIG. 9 is a side view of the fully assembled pour spout assembly.

In the following detailed description of the preferred embodiments, reference is made to the accompanying drawings, which form a part hereof, and within which are shown by way of illustration specific embodiments by which the invention may be practiced. It is to be understood that there are other embodiments by which the invention may be practiced. It is to be understood that other embodiments may be utilized and structural changes may be made without departing from the scope of the invention.

Definitions

As used in the specification and claims, the singular form "a", "an" and "the" include plural references unless the context clearly dictates otherwise.

As used herein, the term "comprising" is intended to mean that the products, systems and methods include the referenced components or steps, but not excluding others. "Consisting essentially of" when used to define products, systems and methods, shall mean excluding other components or steps of any essential significance. "Consisting of" shall mean excluding more than trace elements of other components or steps.

All numerical designations, including ranges, are approximations which are varied up or down by increments of 1.0 or 0.1, as appropriate. It is to be understood, even if it is not always explicitly stated that all numerical designations are preceded by the term "about".

The term "about" or "approximately" as used herein refers to being within an acceptable error range for the particular value as determined by one of ordinary skill in the art, which will depend in part on how the value is measured or determined. As used herein the term "about" refers to +15%.

"Spout seal" or "spout seal apparatus" as used herein refers to an apparatus used to seal the distal end of pour spout conduit and vent tube of a pour spout to prevent liquid from leaking out of a vessel, prevent contaminants from being introduced into the vessel, and maintain freshness of liquid contained within the vessel. Spout seal is removably coupled to connection member of pour spout and when in use, is positioned within neck of vessel.

"Cylindrical attachment member" as used herein refers to a hollow tube member used to removably couple spout seal to pour spout. Cylindrical attachment member has an open proximal and distal ends and is sized to accommodate pour spout conduit and vent tube. Cylindrical attachment member has an outer surface that is in direct contact with inner surface of connection member when inserted into connection member to form a seal. Distal end of cylindrical attachment member is attached to flange. Flange contains a bore opening formed therein. Bore opening corresponds to and forms proximal end of channel extending along a longitudinal axis. Channel is used to house vent tube when spout seal is in use.

"Pour spout" or "spout" as used herein refers to an apparatus capable of insertion into a vessel containing a liquid to allow a continuous flow of liquid contained within the vessel to flow out of the vessel when the vessel is moved from a substantially vertical orientation to a more horizontal orientation. Pour spout generally comprises pour spout conduit, vent tube, and connection member with pour spout conduit and vent tube extending through connection member. In some embodiments, a housing is positioned to enclose pour spout conduit and vent tube as described herein.

"Pour spout conduit" as used herein refers to a cylindrical channel extending perpendicularly from both surfaces of a circular base. Proximal end of conduit extends outwardly from circular base while distal end extends towards vessel when in use. Both proximal and distal ends of conduit are open with proximal open end forming nozzle and distal open end forming fluid intake opening. Pour spout conduit may be straight (180°) or slightly curved at its proximal end. If curved, the angle may be 150°±25°. In some embodiments, the angle is about 179°, 178°, 177°, 176°, 175°, 174°, 173°, 172°, 171°, 170°, 169°, 168°, 167°, 166°, 165°, 164°, 163°, 162°, 161°, 160°, 159°, 158°, 157°, 156°, 155°, 154°, 153°, 152°, 151°, 150°, 149°, 148°, 147°, 146°, 145°, 144°, 143°, 142°, 141°, 140°, 139°, 138°, 137°, 136°, 135°, 134°, 133°, 132°, 131°, 130°, 129°, 128°, 127°, 126°, or 125°.

"Vent tube" as used herein refers to a hollow cylindrical tube, smaller in diameter than pour spout conduit, extending distally perpendicular from an aperture (vent) in surface of circular base. Vent tube is positioned a distance away from pour spout conduit. Vent tube generally extends past distal end of connection member of pour spout and is positioned so that distal end of vent tube is positioned above the contents of the vessel when the vessel is tilted for pouring. Vent tube is used to allow air to enter vessel when liquid is being poured which permits the pressure to equalize within the bottle and encourage an even flow of the liquid from the vessel.

"Pour spout housing" as used herein refers to a hollow structure enclosing the proximal portion of the pour spout conduit. The pour spout housing contains an opening corresponding in size to, and aligned with, the opening (nozzle) at the end of the proximal portion of the pour spout conduit. Pour spout housing is fixedly or removably attached to top surface of circular base.

"Connection member" as used herein refers to a structure capable of being coupled to a pour spout conduit and inserted into the neck of a vessel. In an embodiment, the connection member is comprised of an annular disc positioned proximal to a hollow cylinder having a plurality of annular flanges extending perpendicularly therefrom. In use, hollow cylinder portion of connection member is inserted into the neck of a vessel to couple the pour spout to the vessel. In some embodiments, connection member is manufactured of an elastomeric material.

"Pour spout assembly" as used herein refers to the spout seal coupled to the pour spout.

"Elastomeric" as used herein refers to a material capable of being stretched or deformed under stress and which returns to its original shape when the stress is released.

"Gripping means" as used herein refers to a member on spout seal apparatus that is configured for the user to hold when attaching or removing spout seal apparatus from pour spout. In some embodiments, gripping means may be a tab fixedly attached to a portion of spout seal. In some embodiments, this attachment may be to the outer wall of the channel and/or the bottom surface of the flange.

"Vessel" as used herein refers to any container used to house liquids. In some embodiments, the vessel is an alcoholic beverage bottle; however, other vessels containing liquids are contemplated. If the vessel is an alcoholic beverage bottle such as those containing hard liquor, the spout seal and connection member of the pour spout are sized to fit a standard 20 mm bottle opening.

The present invention provides a removeable spout seal apparatus 10 that can be used to seal a pour spout 80 to keep contaminants out of a vessel, keep the liquid in the vessel fresh, and prevent accidental spills and leaking of the liquid from the vessel. The removeable spout seal apparatus 10 generally comprises a cylindrical attachment member 20 attached to a flange 30 with a channel 50 extending distally perpendicular therefrom. A gripping means 50 such as a tab may be affixed to a portion of the outer wall of the channel 50 and/or the bottom surface 34 of the flange 30.

The removeable spout seal 10 can be used with any standard pour spout. Prior art pour spouts generally consist of a pour spout conduit extending outwardly from, and through, a circular base attached to a connection member that is insertable into the neck of a vessel such as a bottle. Most prior art pour spouts also include a vent tube which extends from an opening in the surface of circular base through interior of connection member.

Alternatively, the spout seal can be used as part of a pour spout assembly 70 as described herein. Generally, pour spout assembly 70 is comprised of pour spout 80 and removeable spout seal 10. In some embodiments, pour spout 80 is additionally comprised of a novelty pour spout housing 90, through which pour spout conduit 100 extends, where novelty housing 90 is removably attached to an elastomeric connection member 130 which is sized for snug insertion into neck 180 of vessel 170.

FIGS. 1-5 depict spout seal apparatus 10. As shown in the images, spout seal apparatus 10 includes cylindrical attachment member 20 fixedly attached to flange 30. Cylindrical attachment member 20 has open proximal and distal ends. Cylindrical attachment member 20 is comprised of inner 22 and outer 24 walls and is sized such that cylindrical attachment member 20 can be inserted into connection member 130 of pour spout 80. Diameter of cylindrical attachment member 20 may be specifically sized for insertion into various diameter connection members provided that when inserted, entire circumference of outer wall 24 of cylindrical attachment member 20 is in direct contact with entire circumference of inner wall 136 of connection member 130 of pour spout 80 to couple spout seal apparatus 10 to connection member 130 of pour spout 80 as shown in FIGS. 5-8. A seal is formed between spout seal apparatus 10 and connection member 130 of pour spout 80 such that a certain amount of force is required by a user to remove spout seal apparatus 10 from connection member 130 of pour spout 80.

Flange 30 is sized to be the same diameter as distal end 134 of connection member 130 of pour spout 80. As such, flange 30 is larger in diameter than cylindrical attachment member 20. Flange 30 has top 32 and bottom 34 surfaces with the distal end of cylindrical attachment member 20 being attached to top surface 32 of flange 30. When cylindrical attachment member 20 of spout seal apparatus 10 is inserted into distal end 134 of connection member 130 of pour spout 80, top surface 32 of flange 30 abuts distal end 134 of connection member 130 of pour spout 800. Bottom surface 34 of flange 30 contains bore opening 40 which forms proximal end of channel 50.

Channel 50, having inner 56 and outer 58 walls, extends perpendicularly from bore opening 40 in bottom surface 34 of flange 30. Distal end 54 of channel 50 is closed while proximal end of channel 50 is open to receive vent tube 110. Length of channel 50 is such that vent tube 110 can be fully accommodated within interior of channel 50. Diameter of channel 50 may be sized to specifically accommodate various diameters of vent tubes 110 provided that inner wall 56 of channel 50 is sized to snugly accommodate vent tube 110 such that spout seal apparatus 10 cannot be removed from pour spout 80 without a certain amount of force being exerted by the user.

In some embodiments, gripping means 60 are fixedly attached to a portion of spout seal apparatus 10 to aid in attachment/removal of spout seal apparatus 10 from pour spout 80. In an embodiment, gripping means 60 is in the form of a tab that is attached to bottom surface 34 of flange 30 and/or outer wall 58 of channel 50. While tab is shown in one embodiment, various configurations of gripping means 60 or tab placement are contemplated. Gripping means 60 can be labeled with the word "REMOVE" to ensure the user knows that the spout seal apparatus 10 must be removed prior to attempting to pour liquid from vessel 170.

Spout seal apparatus 10 may be manufactured from an elastomeric material including, but not limited to, silicone, natural rubber, ethylene propylene rubber, polyurethane elastomers, fluoroelastomers, and nitrile rubbers. Any elastomeric material that can suitably be deformed to fit into the neck of the vessel may be used provided that the material will not contaminate or degrade when in contact with the liquid in the vessel. In some embodiments, spout seal apparatus 10 is manufactured from silicone. Spout seal apparatus 10 can optionally be in a bright color, such as red, to alert a user to remove spout seal apparatus 10 prior to pouring from vessel 170.

Spout seal 10 width cannot be wider than diameter of connection member 130 of pour spout 80 to allow spout seal 10 to fit within neck 180 of vessel 170. Spout seal 10 can be sized for use with various sizes of vessels that use pour spouts to pour liquids. Examples of vessels using pour spouts include, but are not limited to, those containing alcoholic beverages, oils such as olive oils, vinegars, and wines.

FIGS. 6-9 depict the components of one embodiment of pour spout assembly 70. In an embodiment, pour spout housing 90 is shown in the shape of a gargoyle. While a gargoyle is used in the exemplary embodiment, pour spout housing 90 may take any shape provided it is capable of encasing proximal portion of pour spout conduit 100. Pour spout housing 90 contains an opening 92 corresponding in size and aligned with nozzle 102 at the end of the proximal portion of pour spout conduit 100. Pour spout housing 90 is affixed to top surface 126 of circular base 120.

Circular base 120 contains conduit orifice 122 sized to accommodate pour spout conduit 100. In use, pour spout conduit 100 extends through conduit orifice 122 and into connection member 130. A circular vent orifice 124 is formed in and extends through circular base 120. Circular vent orifice 124 is positioned a distance away from pour spout conduit orifice 122. Vent tube 110, having the same diameter as circular vent orifice 122, extends from circular vent orifice 122 perpendicular to bottom surface 128 of circular base 120. Vent tube 110 extends through connection member 130 and into channel 50 of spout seal 10 when spout seal 10 is coupled to connection member 130 of pour spout 80.

Circular base 120 can be fixedly or removably attached to top surface 142 of annular disc 140 of connection member 130. Annular disc 140 of connection member 130 contains a circular vent aperture 146 and circular pour spout conduit aperture 148 to receive vent tube 110 and pour spout conduit 100, respectively. Annular disc 140 has the same diameter as circular base 120. In use, annular disc 140 abuts lip of vessel 170.

Figure 10:
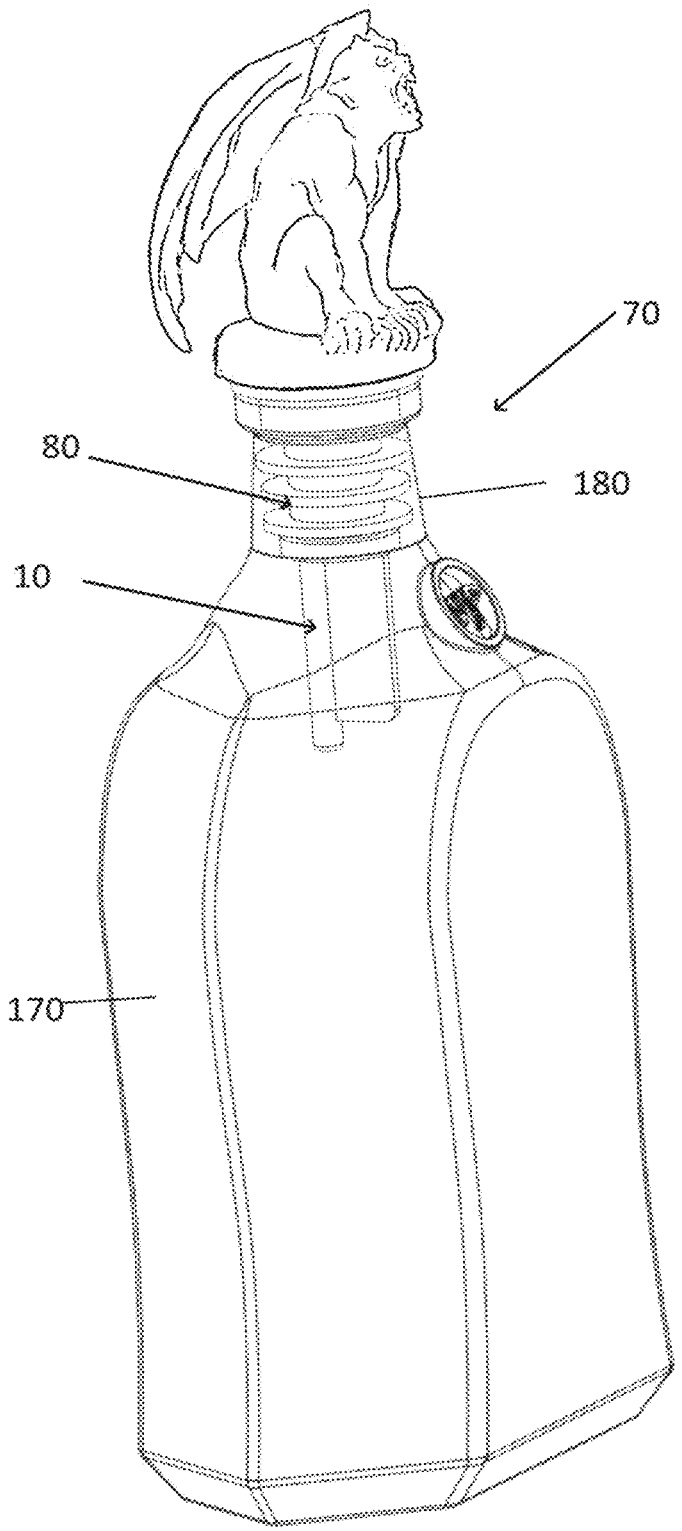
FIG. 10 is a side view of the fully assembled pour spout assembly in use in a vessel.

Connection member 130 is also comprised of hollow cylinder 150 extending perpendicularly from bottom surface 144 of annular disc 140. Both vent tube 110 and pour spout conduit 100 extend through interior of hollow cylinder 150 of connection member 130. However, vent tube 110 extends past distal end 134 of connection member 130 while pour spout conduit 100 terminates within connection member 130. A plurality of annular flanges 160 extend perpendicularly from outer wall of hollow cylinder 150 and are arranged in a spaced relationship to each other. All annular flanges 160 of connection member 130 may be the same diameter or alternatively, each annular flange 160 may have a decreasing diameter from proximal end 132 of connection member 130 to distal end 134 of connection member 130. The diameter of the annual flanges 160 is sized to allow insertion of hollow cylinder 150 portion of connection member 130 into neck 180 of vessel 170 as shown in FIG. 10. Annular flanges 160 are constructed of an elastomeric material which allows for a seal when positioned within neck 180 of vessel 170.

Spout seal 10 is the last component of pour spout assembly 70. As noted previously, spout seal 10 is comprised of cylindrical attachment member 20 affixed to top surface 32 of flange 30. Channel 40 extends from bore 40 in bottom surface 34 of flange 30 and is sized to accommodate vent tube 110.

In use, spout seal 10 is coupled to pour spout 80 by inserting vent tube 110 into channel 50 of spout seal 10 while inserting cylindrical attachment member 20 into connection member 130 of pour spout 80. Due to the elastomeric materials used, a tight, leakproof fit is accomplished. Pour spout assembly 70 is then inserted into neck 180 of vessel 170 as shown in FIG. 10. By covering access to both pour spout conduit 100 and vent tube 110 and ensuring a tight fit, spout seal 10 prevents leaking of any liquid from vessel 170. When the user wishes to pour from the vessel 170, pour spout assembly 70 is removed from neck 180 of vessel 170 and the spout seal 10 is removed from pour spout 80. Pour spout 80 can then be reinserted into neck 180 of vessel 170 and pouring can occur.

In conclusion, the instant invention overcomes the deficiencies of the prior art and allows for a removeable spout seal apparatus that can be used to seal a pour spout to keep contaminants out of the vessel, keep the liquid in the vessel fresh, and prevent accidental spills and leaking of the liquid from the vessel. The spout seal can be used with prior art pour spouts having vent tubes and pour spout conduits. Alternatively, the spout seal can be used as part of a pour spout assembly which includes a pour spout, potentially with a pour spout housing, and the spout seal.

In the preceding specification, all documents, acts, or information disclosed does not constitute an admission that the document, act, or information of any combination thereof was publicly available, known to the public, part of the general knowledge in the art, or was known to be relevant to solve any problem at the time of priority.

The disclosures of all publications cited above are expressly incorporated herein by reference, each in its entirety, to the same extent as if each were incorporated by reference individually.

It will thus be seen that the objects set forth above, and those made apparent from the foregoing disclosure, are efficiently attained. Since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein disclosed, and all statements of the scope of the invention that, as a matter of language, might be said to fall therebetween. Now that the invention has been described.

What is claimed is:

1. A removable spout seal apparatus comprising:

a cylindrical attachment member having opposing ends and an inner and an outer wall;

a flange having top and bottom surfaces wherein the top surface of the flange is fixedly attached to an end of the cylindrical attachment member wherein the bottom surface of the flange contains a bore opening; and a channel having an open proximal end formed from the bore opening and extending perpendicularly from a bottom surface of the flange to terminate in a closed distal end.

2. The apparatus of claim 1, further comprising gripping means fixedly attached to the bottom surface of the flange.

3. The apparatus of claim 2, wherein a portion of the gripping means is fixedly attached to an outer wall of the channel.

4. The apparatus of claim 1, wherein the cylindrical attachment member is smaller in diameter than the diameter of the flange.

5. The apparatus of claim 4, wherein the cylindrical attachment member is sized for insertion into a connection member of a pour spout.

6. The apparatus of claim 5, wherein the spout seal apparatus is sized for insertion into a neck of a vessel.

7. The apparatus of claim 1, wherein the channel is sized to accommodate a vent tube of a pour spout.

8. A pour spout assembly comprising:

a pour spout coupled to a removeable spout seal apparatus;

wherein the spout seal apparatus comprising a cylindrical attachment member having opposing ends and an inner and an outer wall;

a flange having top and bottom surfaces wherein the top surface of the flange is fixedly attached to an end of the cylindrical attachment member wherein the bottom surface of the flange contains a bore opening; and a channel formed from the bore opening and extending perpendicularly from a bottom surface of the flange.

9. The pour spout assembly of claim 8, further comprising gripping means fixedly attached to the bottom surface of the flange of the spout seal apparatus.

10. The pour spout assembly of claim 8, wherein the pour spout comprising:

a pour spout conduit having opposing proximal and distal ends wherein the proximal end terminates in a nozzle;

a vent tube having opposing proximal and distal ends and positioned a distance from the pour spout conduit; and a connection member sized for insertion into a neck of a vessel;

wherein the pour spout conduit and the vent tube extend through a hollow cylinder of the connection member.

11. The pour spout assembly of claim 10, further comprising a pour spout housing enclosing proximal end of pour spout conduit.

12. The pour spout assembly of claim 11, wherein the pour spout housing contains a circular opening in alignment with and corresponding in size to the nozzle of pour spout conduit.

13. The pour spout assembly of claim 12, wherein the pour spout housing is coupled to a circular base.

14. The pour spout assembly of claim 8, wherein the cylindrical attachment member is smaller in diameter than the diameter of the flange.

15. The pour spout assembly of claim 14, wherein the cylindrical attachment member is sized for insertion into the connection member of a pour spout.

16. The pour spout assembly of claim 8, wherein the spout seal apparatus is sized for insertion into a neck of a vessel.

17. The pour spout assembly of claim 8, wherein the channel is sized to accommodate a vent tube of a pour spout.

18. A method of preventing liquid from leaking out of a vessel having a pour spout comprising:

coupling a spout seal apparatus to the pour spout to form a pour spout assembly wherein the spout seal apparatus comprising cylindrical attachment member having opposing ends and an inner and an outer wall;

a flange having top and bottom surfaces wherein the top surface of the flange is fixedly attached to an end of the cylindrical attachment member wherein the bottom surface of the flange contains a bore opening; and a channel having an open proximal end formed from the bore opening and extending perpendicularly from a bottom surface of the flange to terminate in a closed distal end; and inserting the pour spout assembly into a neck of the vessel;

wherein the spout seal apparatus forms a seal with the pour spout to prevent the leaking of the liquid from the vessel.

19. The method of claim 18, wherein when coupled, a vent tube of the pour spout is positioned within the channel of the spout seal apparatus and the cylindrical attachment member is inserted into a connection member of the pour spout to provide the seal.

* * * * *